US010384817B2

(12) United States Patent
Grassi

(10) Patent No.: US 10,384,817 B2
(45) Date of Patent: Aug. 20, 2019

(54) WRAPPING HEAD FOR LOADS, PARTICULARLY FOR PALLETIZED LOADS AND METHOD OF OPERATION THEREOF

(71) Applicant: BEMA S.R.L., Viano (Reggio Emilia) (IT)

(72) Inventor: Antonio Grassi, Viano (IT)

(73) Assignee: BEMA S.R.L., Viano (RE) (IT)

( * ) Notice: Subject to any disclaimer, the term of this patent is extended or adjusted under 35 U.S.C. 154(b) by 413 days.

(21) Appl. No.: 15/039,336

(22) PCT Filed: Nov. 26, 2014

(86) PCT No.: PCT/IB2014/002573

§ 371 (c)(1),
(2) Date: May 25, 2016

(87) PCT Pub. No.: WO2015/079306

PCT Pub. Date: Jun. 4, 2015

(65) Prior Publication Data

US 2017/0166334 A1 Jun. 15, 2017

(30) Foreign Application Priority Data

Nov. 26, 2013 (IT) ..... VR2013A0257

(51) Int. Cl.
*B65B 11/00* (2006.01)
*B65B 11/04* (2006.01)
(Continued)

(52) U.S. Cl.
CPC ..... *B65B 11/045* (2013.01); *B65B 41/16* (2013.01); *B65B 65/02* (2013.01)

(58) Field of Classification Search
CPC ..... B65H 45/22; B65B 11/045; B65B 41/12; B65B 2210/16; B65B 2210/20;
(Continued)

(56) References Cited

U.S. PATENT DOCUMENTS 4,395,255 A * 7/1983 Branecky ..... B65H 45/22 493/439
4,596,467 A * 6/1986 Bartelt ..... G03F 9/7049 356/509
(Continued)

FOREIGN PATENT DOCUMENTS

EP 0300855 A1 1/1989
EP 0466980 A1 1/1992
EP 0638505 A1 2/1995

OTHER PUBLICATIONS

International Search Report dated Apr. 9, 2015 for International Application No. PCT/IB2014/002573.

*Primary Examiner* — Andrew M Tecco
*Assistant Examiner* — Eyamindae C Jallow
(74) *Attorney, Agent, or Firm* — Tutunjian & Bitetto, P.C.

(57) ABSTRACT

The present invention relates to a head for wrapping loads, particularly for palletized loads, including at least one support framework for at least one reel of extensible material, the support framework including at least one pair of plates connected to each other through a longitudinal plate extending along a longitudinal axis (x-x) of the framework, the reel being supportable by the support framework parallel to the axis (x-x) and the extensible material, in use, can be unwound from the at least one reel along a delivery plane (P), at least means for the return of the extensible materials supported by the at least one support framework along the longitudinal axis (x-x). The wrapping head includes at least one group for folding the extensible material, downstream of the return means, the folding group being predisposed, in use, to engage and fold at least one peripheral portion (p) of such extensible material on itself, hence obtaining a double layer band (F) of such extensible material.

15 Claims, 6 Drawing Sheets

(51) Int. Cl.
*B65B 65/02* (2006.01)
*B65B 41/16* (2006.01)

(58) Field of Classification Search
CPC ..... B65B 2210/18; B65B 11/00; B65B 41/16; B65B 65/02
USPC ..... 53/211, 399, 587, 441, 588, 135.3, 203; 428/121
See application file for complete search history.

(56) References Cited

U.S. PATENT DOCUMENTS

| | | | | | |
|---|---|---|---|---|---|
| 4,754,594 | A * | 7/1988 | Lancaster | B65B 11/045 | 53/399 |
| 4,905,451 | A * | 3/1990 | Jaconelli | B65B 11/045 | 493/440 |
| 5,531,393 | A * | 7/1996 | Salzsauler | B29C 55/06 | 242/160.4 |
| 5,656,222 | A * | 8/1997 | Berry | B32B 27/08 | 264/131 |
| 6,592,699 | B1 * | 7/2003 | Mehta | B29C 53/36 | 156/227 |
| 8,128,018 | B2 * | 3/2012 | Shek | A47K 10/3836 | 242/564.4 |
| 8,221,298 | B2 * | 7/2012 | Pirtle | B65H 18/10 | 493/356 |
| 8,940,385 | B2 * | 1/2015 | Jager | B32B 37/0076 | 156/269 |
| 9,630,799 | B2 * | 4/2017 | Galea | B65H 45/22 | |
| 2004/0163364 | A1 * | 8/2004 | Cousins | B65B 11/045 | 53/556 |
| 2009/0120307 | A1 * | 5/2009 | Koskela | B65B 11/025 | 100/27 |

* cited by examiner

WRAPPING HEAD FOR LOADS, PARTICULARLY FOR PALLETIZED LOADS AND METHOD OF OPERATION THEREOF

FIELD OF THE INVENTION

The present invention relates to a head for wrapping loads, more in particular palletized loads and the respective operating method.

STATE OF THE PRIOR ART

As known, the palletized loads consist in one or more goods arranged on a pallet with the aim of facilitating the movement and transportation thereof. When transporting a palletized load, in order to prevent goods from falling or spilling, it is provided for laterally binding or wrapping the load itself using a layer of extensible material, for example in the form of a film made of plastic material.

The wrapping of a palletized load is generally carried out using automatic or semi-automatic binding stations, comprising means for moving a wrapping head, which head carries one or more reels of such extensible material which can be unwound and wound around the load. There are various types of binding stations, in which the palletized load is provided for substantially stationary or rotating around a longitudinal axis thereof and the wrapping head, moved by the respective movement means, may be correspondingly rotatably supported around the stationary load or it may be at a fixed position at a predetermined distance from the rotatable load and it can be translated vertically and parallel to the load.

In this manner, the extensible material of the reel can be unwound from the wrapping head there by forming a series of spiral windings around the palletized load, starting from an end of the same, both at the upper and lower end thereof, until a stabilizing wrapping of the load is obtained.

At the end of the binding, the extensible material so used is cut using suitable means mounted on the wrapping head and the film strip thus obtained is fixed to the palletized load, for example sealed using a special stopper element. The aforementioned binding stations can be subjected to improvements aimed at increasing the stability and resistance of the load stabilized by binding, during the transport.

As a matter of fact, as known, during transportation a palletized load is subjected to high stresses (acceleration-deceleration) both of the longitudinal and transverse type.

In particular, if the film reel made of plastic material to be wound around the palletized load has a height that can be compared to that of the load to be palletized, a typical example is that of the 1000 mm high film reels and 1200-1500 mm high loads to be palletized, during the spiral winding of the film on the load, height superimpositions of the film layers are obtained which are relatively high, also, for example, in the order of 300 mm.

Due to the considerable superimposition of the layers of the applied binding, the film also exerts an excessive pressure in the central portion of the load obtaining a so-called "hourglass" effect with the resulting crushing-deformation of possible yieldable means carried thereby.

The vertical stresses the load is subjected to during transportation also temporarily nullify the weight force of the goods of the palletized load, with the resulting reduction of the friction force between one layer of the goods and the other.

Besides this, the portion of the load most subjected to the sliding of the goods on the pallet is that at direct contact with the pallet, given that the pallet delimits a support surface for resting the goods which is almost flat and with low degree of friction while in the upper layers the goods, usually having shapes that are not perfectly even, offer greater resistance to the sliding. In addition, it should be observed that the law in force with reference to transportation of palletized loads introduced—in some countries of the European Union—stricter rules according to which the palletized loads would be "suitably stabilized" only if capable of resisting to pre-established longitudinal and transverse stresses during the entire transport chain (from production up to the end user).

Thus, currently, with the aim of overcoming the drawbacks outlined above and obtaining a "suitable" binding of the palletized load, it is foreseen to firmly wind the film made of plastic material to the base of the load obtaining several windings between the pallet and the lower layer of goods.

In EP 0466980, for example, there is disclosed to wind one layer of extensible material in a spiral fashion around a load supported by a pallet, wherein a strip of the layer of extensible material may be folded and/or wound thereon. In EP 0466980, however, the configuration of a wrapping head designed for obtaining such winding is disclosed, nor how such folding and/or winding of the strip/s of the layer of extensible material is obtained.

In EP 0638505, moreover, the possibility of folding the strips of a layer of extensible material is disclosed. However, EP 0638505 does not describe the configuration of an apparatus designed for obtaining such folding nor a winding around a palletized load. This operation of firmly winding the base of the palletized load using the film made of plastic material not only does not overcome the "hourglass" effect problem, especially evident for small loads with respect to the longitudinal extension of the extensible material used for binding, it also logically involves an increase of consumption of the plastic material used for binding the load as well as a considerable increase of the consumption costs of the palletized goods.

Thus, the need of being able to use the wrapping head for palletized loads arises, which reduces to the minimum the consumption of the plastic material used for binding the load for guaranteeing good stability of the same.

SUMMARY OF THE INVENTION

Thus, the main object of the present invention is to provide a head for wrapping loads, more in particular for palletized loads, which allows to "suitably stabilize" the load.

Another object of the present invention is to provide a head for wrapping palletized loads, capable of reducing to the minimum the consumption of plastic material used for wrapping the load.

A further object of the present invention is to provide a head for wrapping palletized loads that is easy to obtain at competitive prices.

Not the last object of the present invention is to provide a method for operating a wrapping head that is easy to implement.

According to a first, aspect of the present invention there is provided a head for wrapping palletized loads according to the present principles.

According to a further aspect of the present invention there is provided a method for operating a wrapping head according to the present principles.

Further advantages and characteristics of the head for wrapping palletized loads according to the present invention are described in the present specification.

BRIEF DESCRIPTION OF THE DRAWINGS

Further aspects and advantages of the present invention shall be more apparent from the following detailed description of some of the currently preferred embodiments thereof, illustrated purely by way of non-limiting example in the attached drawings, wherein.

DETAILED DESCRIPTION OF EMBODIMENTS OF THE INVENTION

Figure 1:
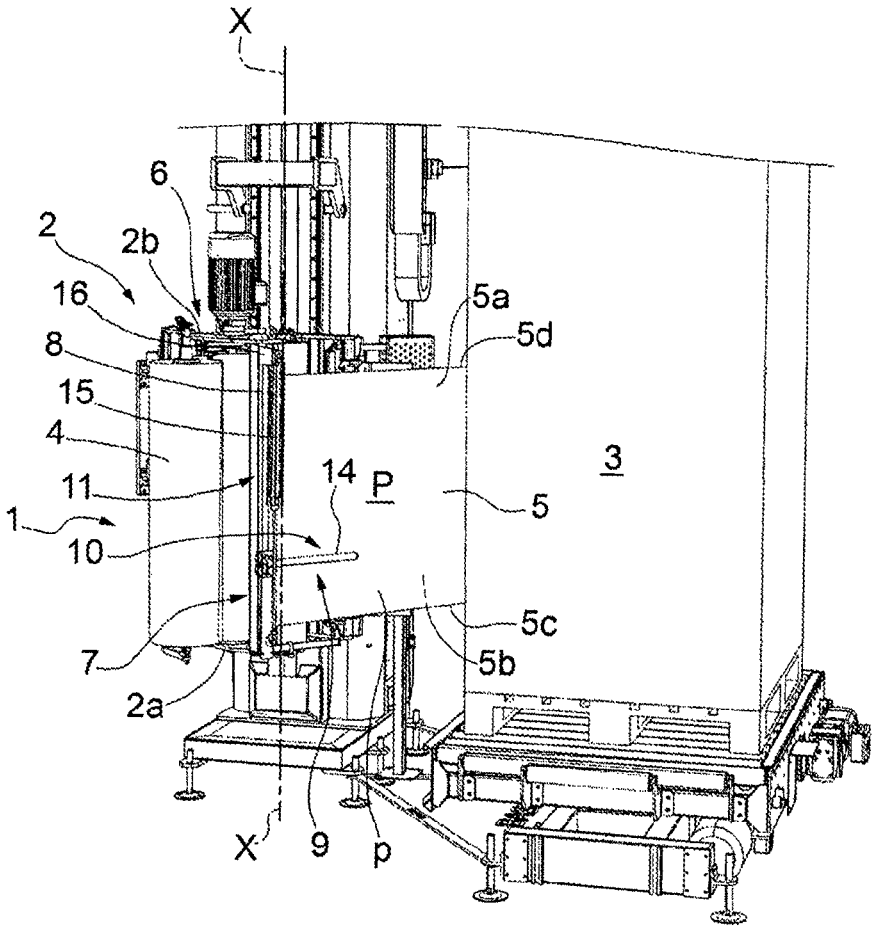
FIG. 1 is a perspective view slightly from above, of a binding station provided with a wrapping head according to the present invention in an initial operating step.
Figure 2:
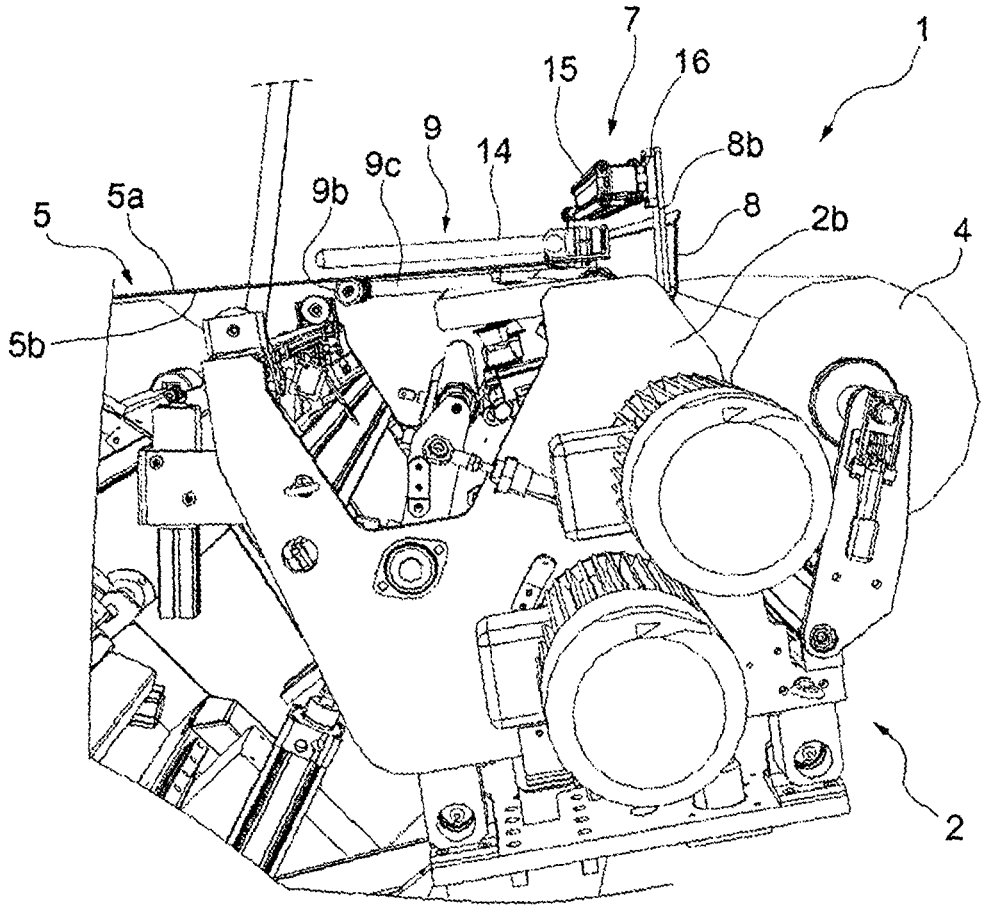
FIG. 2 illustrates a top view, in enlarged scale, of the wrapping head of FIG. 1.

In the exemplifying embodiment below reference shall be made to a binding station in which the palletized load is provided rotating along a longitudinal axis thereof on a special support platform and the wrapping head only performs substantially vertical movements. However, it is clear that the present invention may also be applied to a binding station in which the palletized loads is locally stationary and the wrapping head, moved by the respective movement means, is considerably rotatably supported around the aforementioned stationary load.

With reference to FIGS. 1 to 6 attached, it is observed that a head for wrapping palletized loads according to the present invention is indicated in its entirety with the reference number 1 and it comprises at least one support framework 2 obtained using a pair of plates, for example a first plate 2*a*, used at the lower part, and a second plate 2*b*, used at the upper part, joined to each other for example through a crosspiece (not observable from the drawings). The support framework 2 can be translated, as known, longitudinally and parallel to a palletized load 3 and it supports a reel 4 made of extensible material 5, rotating around a longitudinal axis parallel to a longitudinal axis x-x of the framework.

The extensible material 5 of the reel 4 can be unwound along a delivery plane P with the face 5*a* thereof facing, in use, towards the palletized load 3 and the other face 5*b* facing, in use, towards the support framework 2, and it is delimited by a first edge 5*c*, used at the lower part, and a second edge 5*d*, used at the upper part.

The wrapping head also comprises return means 6 for the extensible material 5, which can be unwound from the reel 4. For example, these return means comprise a plurality of rollers supported by the framework 2 parallel to the reel 4 and predisposed for returning the extensible material 5 unwound from the reel towards the palletized load 3.

Figure 5:
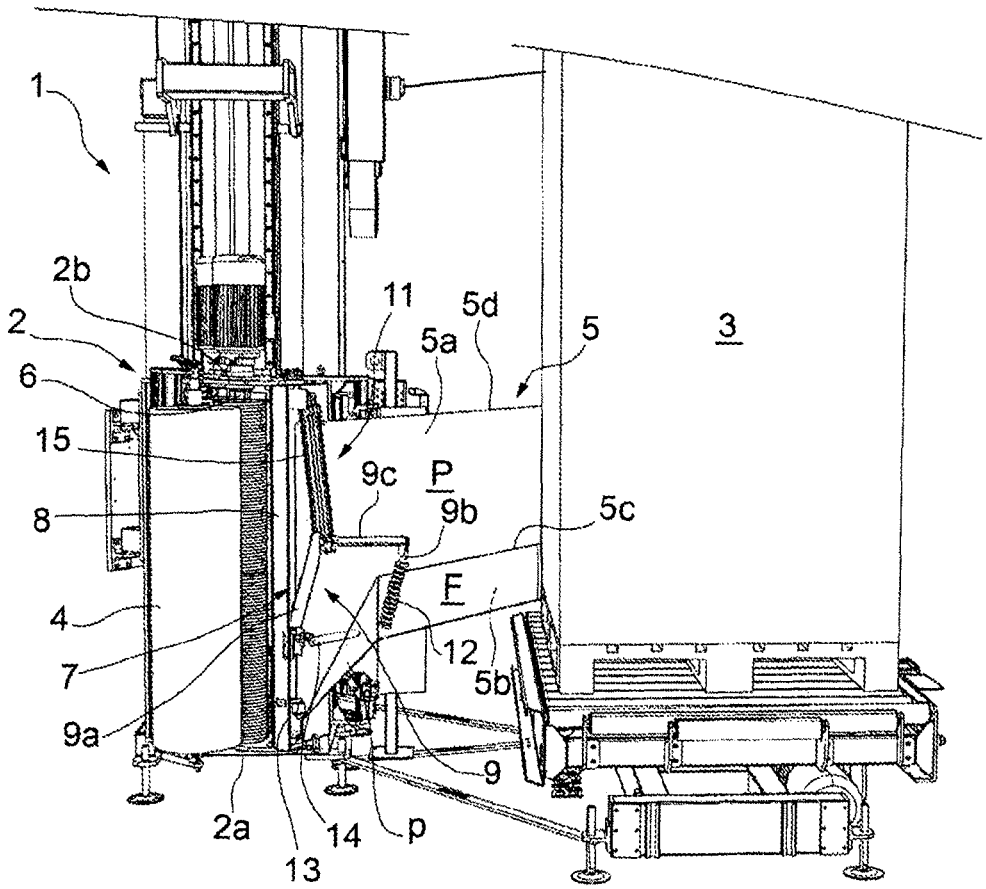
FIG. 5 shows a perspective view, slightly from above, of a binding station provided with a wrapping head according to the present invention in an end operating step.
Figure 6:
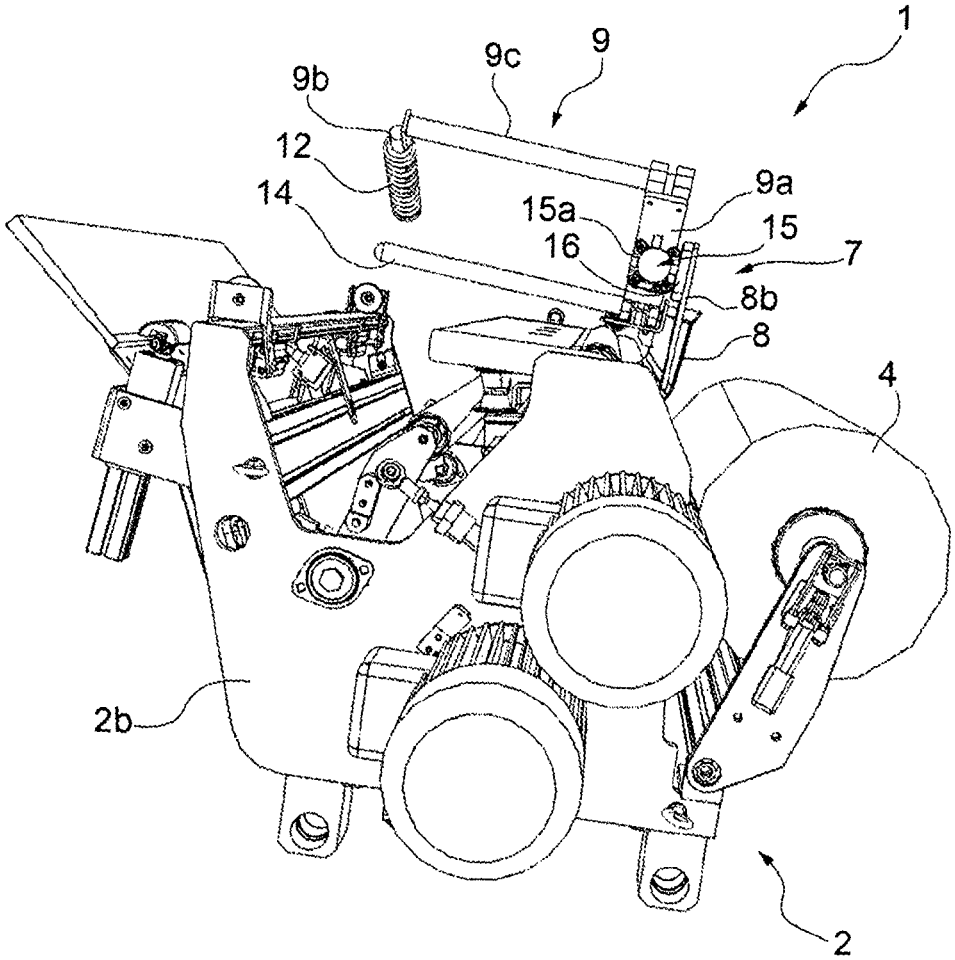
FIG. 6 illustrates a top view, in enlarged scale, of the wrapping head represented in FIG. 5.

Advantageously, the wrapping head according to the present invention comprises a group 7 for folding the extensible material 5, predisposed for folding a peripheral portion (used at the lower part) of the material thereon, thus obtaining a double layer band F of material (F in FIG. 5).

The folding group 7 is mounted on the support 2 downstream of the return means 6, for example at a longitudinal connection plate 8 between the plates 2*a* and 2*b* therefor provided, and it comprises tiltable means 9, actuator means 11 and guide means 10 provided for cooperating, as described hereinafter, to obtain the folding of a lower in use portion of the extensible material 5, returned towards the palletized load, thus obtaining the double layer band F. For such purpose, the means 9 for tilting the folding group 7 are arranged with respect to the extensible material 5 so as to engage a peripheral portion p thereof, during the angular displacement between the first and the second operating position, thereby obtaining two layers of extensible material.

Figure 3:
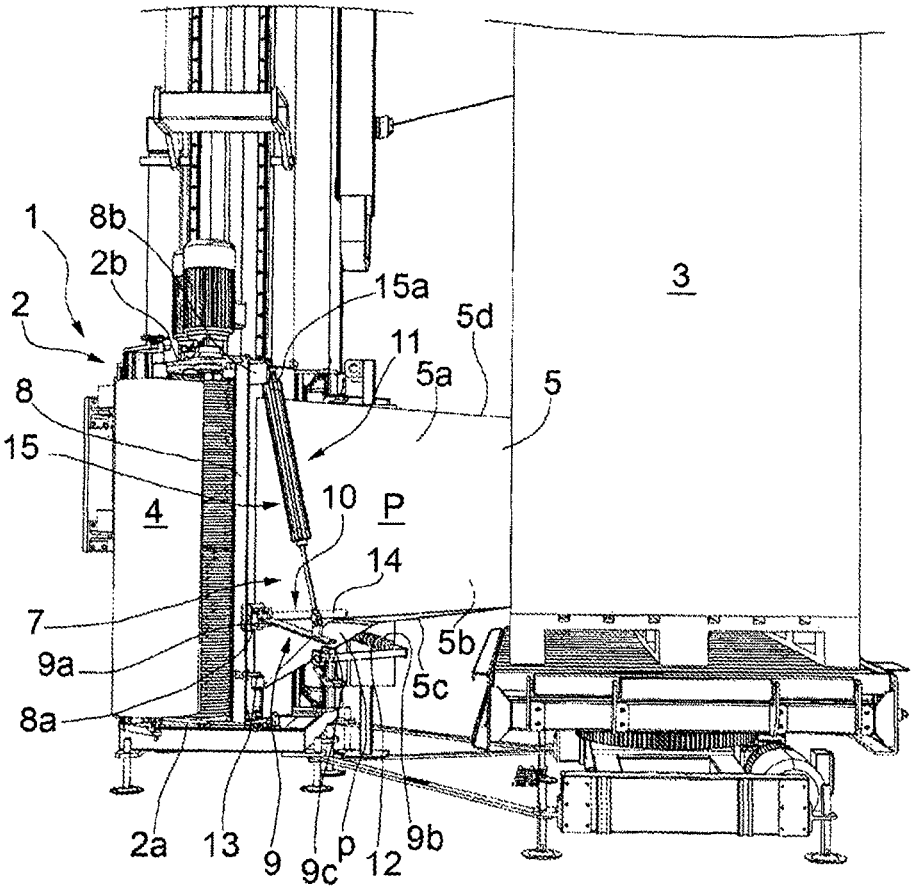
FIG. 3 shows a view from above of a binding station provided with a wrapping head according to the present invention in an intermediate operating step.
Figure 4:
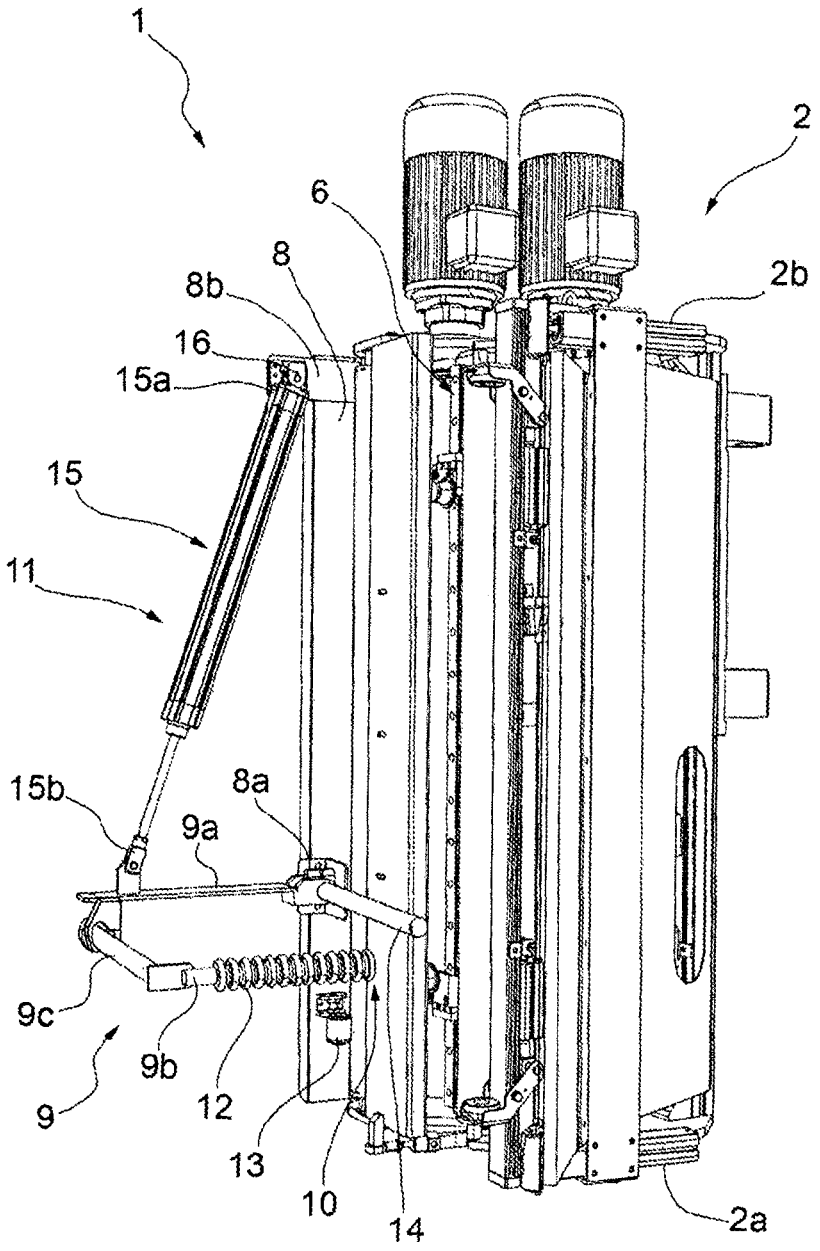
FIG. 4 illustrates a top view, in enlarged scale, of the wrapping head represented in FIG. 3.

More particularly, see FIGS. 3 and 4, the tiltable means 9 are hinged to a hinging bracket 8*a*, fixed, for example bolted or welded, to the longitudinal plate 8 and they can be angularly displaced around an axis Y-Y substantially orthogonal to the support framework 2 and parallel to the delivery plane P.

The tiltable means 9 comprise a substantially U-shaped rigid structure having a longitudinal first longitudinal section 9*a* and a second longitudinal section 9*b* connected to each other through a transverse section 9*c*. The transverse section 9*c* of the rigid structure, as illustrated in FIGS. 3 and 4, has—at the end thereof for connecting to the first longitudinal section 9*a* (not visible in the drawings)—a substantially polygonal section inserted in suitable fastening means, for example a pair of shaft supports, bolted to the first section 9*a*. At the other end, the section 9*c* is fixed for example welded, to the second transverse section 9*b*.

The tiltable means 9 are hinged to the plate 8 of the framework 2 at the free end 9*d* of the first longitudinal section 9*a* and, in the first operating position, they are substantially entirely beneath such end 9*d*.

As observable, in such operating position (in particular see FIG. 2) the second longitudinal section 9*b* of the tiltable means is arranged between the support framework 2 and the face 5*b* of the extensible material 5, i.e. the one facing the framework.

Advantageously, on the second longitudinal section 9*b* of the tiltable means 9 a roller unit 12 is mounted, for example idle, for facilitating the sliding of the extensible material 5 unwound from the reel 4 and directed towards the palletized load 3. The extensible material 5 is actually at contact with such second longitudinal section 9*b*.

The configuration of the tiltable means 9 described above is advantageous in that it is simple to obtain. In any case, a man skilled in the art shall easily understand that other configurations are possible, as long as at least one portion of the same is provided between the face 5*b* of the extensible material 5 and the framework 2 in the first operating position and thus it can engage a peripheral portion p of the extensible material 5 during the angular movement from the first to the second operating position. The rigid structure of the tiltable means 9 could be, for example, a single piece or have a configuration, for example, shaped to form an "S" or the like.

As mentioned above, the folding group 7 of the wrapping head 1 according to the present invention provides for guide means 10, which are predisposed to guide the extensible material 5 exiting the return means 6 to facilitate the folding of the material itself and thus form the double layer band F. For such purpose, the guide means 10 comprise at least one roller 13 rotatably mounted on the plate 8 around an axis parallel to the longitudinal axis x-x of the framework 2. The roller 13 is preferably elastically loaded and it maintains the extensible material 5 adhering to the return means 6 at the folding group (as represented in FIG. 3). The roller 13 is, in use, at the first edge 5*c*, lower in use, of the extensible material.

The guide means 10 also comprise at least one curving means 14, for example a bar 14 with rounded cross-section, cantilever-wise fixed on the plate 8 of the framework 2, at the articulation of the tiltable means 9 and arranged, along the aforementioned axis y-y, between the face 5*a* of the extensible material 5 and the palletized load 3.

Alternatively to the bar, the curving means 14 can comprise any rounded element at the lower part, for example a folded lamina, made of any suitable anti-stick material, having a section with concavity facing towards the upper plate 2*b* of the wrapping head, with radius of curvature such to allow the sliding of the extensible material 5 exiting from the return means 6 and, at the same time, capable of accompanying the material during the folding step thus avoiding the occurrence of unwanted sticking.

As it will be noted, the distance from the longitudinal plate between the roller 13 and the curving means 14 of the guiding means 10 delimits the height of the double layer band F, which can be obtained using a wrapping head according to the present invention.

Preferably, such distance shall be comprised between about 250 and 300 mm. Actually, the binding of this size allows firmly constraining the pallets to each other and the goods arranged thereon, thus avoiding the drawbacks described above related to the sliding of the load, limiting at the same time the consumption of extensible material and thus allowing reducing the costs of the transported goods.

The binding group 7 of the wrapping head according to the present invention provides for, as mentioned above, actuator means 11 for the angular movement of the tiltable means 9 between a first operating position, in which they are found substantially completely beneath the hinging end 9*d* of the first longitudinal section 9*a*, and a second operating position, in which they are found substantially completely above the end 9*d*.

The actuator means 11 comprise—for such purpose—at least one cylinder-piston unit 15 articulated, on the one hand, to the longitudinal plate 8 of the support framework 2, and on the other hand, to the tiltable means 9 of the folding group 7.

More in particular, see FIGS. 3 and 4, the cylinder-piston unit 15 has a first end 15*a* of the cylinder hinged to a hinging bracket 16 in turn fixed, for example laterally bolted to a plate 8*b* projecting cantilevered from the longitudinal plate 8 of the support framework 2 in proximity of the plate 2*b* thereof.

The free end 15*b* of the stem of the cylinder-piston unit is instead articulated, preferably hinged, on the tiltable means 9 at the joining area between the first longitudinal section 9*a* and the transverse section 9*c*.

In the illustrated embodiment, the free end 15*b* of the system of the cylinder-piston unit is connected, through a bushing element, to a fork-like element in turn hinged on a shaft rotatably mounted in a projecting portion obtained on the first longitudinal section 9*a* of the rigid structure of the tiltable means 9 and contingently delimiting a seat for housing the shaft.

However, the man skilled in the art shall understand that other forms of actuator means 11 are possible, as long as capable of causing the angular excursion to the tiltable means in the direction described above. For example, instead of the cylinder-piston unit 15 there could be provided for a reversible gear motor group of any suitable type, mounted on the longitudinal plate 8 of the support framework 2 at the free end 9*d* of the tiltable means 9 and predisposed to cause it to execute, as known to a man skilled in the art, the angular movement between the first and the second operating position.

The operation of the head for wrapping palletized loads described above is rather simple and reliable.

As a matter of fact, upon predisposing a station for wrapping a palletized load provided with a wrapping head according to the present invention, it is provided for disposing the wrapping head at an end used at the lower or upper part of the palletized load 3 with the tiltable means 9 arranged in the first operating position (FIGS. 1 and 2) and i.e. substantially entirely beneath the hinged edge 9*d* and with at least one portion of the second longitudinal portion 9*b* of the same arranged between the face 5*b* of the extensible material 5 faced towards the support framework 2 and the framework.

Upon starting the wrapping step as known, when the wrapping head according to the present invention is at the lower end of the palletized load 3, there is provided for the activation (in a manner entirely known to a man skilled in the art) of the actuator means 11 of the folding group 7, so as to singularly move the tilting means 9 from the first to the second operating positions. During the movement from the first and the second operating means, the tiltable means 9, more in particular the second longitudinal section 9*b* of the rigid structure, engage a peripheral portion p, used at the lower part, of the extensible material 5 and, collaborating with the guide means 10, tilt it to form a double layer band F of extensible material with height substantially equivalent to the distance, along the longitudinal plate 8, between the guide means 13 and 14 or, entirely equivalent, between the guide and hinging means of the tiltable means 9.

After a given period of time, sufficient to wind the pallet and the lower layer/s of goods thereof arranged with a given number of rotations of the extensible material 5 with two layers, the actuator means are actuated, still in a manner known to a man skilled in the art, to carry the tiltable means 9 of the folding group 7 once again in the first operating position, so that the extensible material 5 exiting from the wrapping head according to the present invention shall return to be wound to a single layer around the load, thus optimizing the consumption of the material.

The head for wrapping the palletized loads and the respective operating method described above can be subjected to numerous modifications and variants within the scope of protection of the claims that follow.

Thus, for example, the guide means 10 of the folding group 7 may optionally comprise one or more auxiliary rollers, substantially analogous to the roller 13, mounted spaced from each other along the longitudinal plate 8 and predisposed to maintain the extensible material 5 exiting from the return means in positioning thus avoiding, during the folding step, unwanted adherence between the mutually approaching portions of extensible material.

In addition, the tiltable means 9 and the curving means 14 (the bar) of the guide means 10 according to a variant of the wrapping head of the present invention can be mounted translatable along the plate 8 of the support framework 8, for example with the hinging bracket 8*a* controllably fixed to a slidable slide (both automatic and manual) in a corresponding longitudinal guide provided for on the plate 8. In this case, the operating method of the guide head, additionally to the step, both initial and initial intermediate for positioning the wrapping head at an end of the load with tiltable means 9 arranged in the first operating position provides for a further step of setting the distance between the roller 13 and the bar 14 of the guide means 10, so as to establish, depending on the type of load, the longitudinal width of the double layer band F for wrapping the load at the contact area between the pallets and lower layers of goods placed thereon.

Thus, in addition, also the actuator means 11 could be mounted translatable along the plate 8 of the support network 8 alongside the tiltable means 9 and the bar 14, for example in that they are rigidly connected in any suitable manner.

Lastly, as observable the wrapping head according to the present invention was described and illustrated with reference to a binding station of the type with palletized load 3 rotatable around the longitudinal axis thereof and wrapping head in a fixed position at a given distance with respect thereto. However, the wrapping head can also be implemented in binding stations of different type.

The invention claimed is:

1. A wrapping head for loads, particularly for palletized loads, comprising:

at least one support framework for at least one reel of extensible material, said support framework comprising at least one pair of plates connected to each other by means of a longitudinal plate extending along a longitudinal axis (x-x) of the framework, said reel being supportable by said support framework parallel to said axis (x-x) and said extensible material being, in use, unwindable from said at least one reel along a delivery plane (P), with a face facing said palletized load and a face facing said support framework between a first and a second edge;

at least return means for said extensible material, which return means are supported by said at least one support framework along said longitudinal axis (x-x);

at least one folding group for said extensible material, downstream of said return means, said folding group being designed, in use, for engaging and folding at least one peripheral portion (p) of said extensible material on itself, thereby obtaining a double layer band (F) of said extensible material wherein said at least one folding group is supported by said support framework at said longitudinal plate and comprises:

at least some tiltable means design to tilt between a first working position and a second working position, around an axis (y-y) which is substantially orthogonal to said axis (x-x) of said framework and parallel to said delivery plane (P);

actuating means for said tiltable means; and guide means for said extensible material, designed to keep in position said extensible material exiting said return means, thereby avoiding, during folding, undesired adhesions between the portions of extensible material approaching each other, said guide means including at least one curving means, connected to said support framework at the articulation of said tiltable means, said at least one curving means being arranged along said axis (y-y);

said curving means including a rounded element at the lower part, made of any suitable anti-stick material, having a section with concavity facing towards an upper plate of the wrapping head, with radius of curvature such to allow the sliding of the extensible material exiting from the return means and, at the same time, capable of accompanying the material during the folding step thus avoiding the occurrence of unwanted sticking, wherein said guide means comprise at least one roller rotatably mounted on said support framework around an axis parallel to the longitudinal axis (x-x) thereof and, in use, at said first edge of said extensible material.

2. The wrapping head according to claim 1, wherein said at least one roller is elastically loaded.

3. The wrapping head according to claim 1, wherein said at least one curving means comprises a bar having a rounded cross-section.

4. The wrapping head according to claim 1, wherein said tiltable means are articulated to said support framework.

5. The wrapping head according to claim 4, wherein said tiltable means are pivoted on said support framework.

6. The wrapping head according to claim 4, wherein at least one portion of said tiltable means is arranged, in said first working position, between said face of said extensible material facing said support framework and the support framework itself, at said peripheral portion (p) of said extensible material.

7. The wrapping head according to claim 1, wherein said tiltable means comprise a substantially U-shaped rigid structure having a first and a second longitudinal section connected to each other by means of a transverse section, said tiltable means being connected to said support framework at a free end of said first longitudinal section.

8. The wrapping head according to claim 7, wherein said tiltable means, arranged, in use, between said support framework and said face of said extensible material facing, in use, towards said support framework, comprise said second longitudinal section.

9. The wrapping head according to claim 7, comprising at least one roller means idly mounted on said at least one second longitudinal section.

10. The wrapping head according to claim 7, wherein said actuating means for said tiltable means comprise means for angularly displacing said tiltable means between said first working position, wherein said tiltable means are arranged substantially beneath said free end, and said second working position, wherein they are arranged substantially above said free end.

11. The wrapping head according to claim 1, wherein said actuating means comprise at least one cylinder-piston unit articulated, on one side to said support framework and, on the other side to said tiltable means of said at least one folding group.

12. The wrapping head according to claim 1, wherein said tiltable means and said actuator means are mounted on the support framework, said support framework being longitudinally translatable along axis (x-x).

13. A method of operation of a wrapping head for palletized loads, comprising the following steps:

arranging a wrapping station for palletized loads having a wrapping head according to claim 1;

arranging said wrapping head at an end of the palletized load and with said tiltable means of said at least one folding group in said first working position;

starting the delivery of said extensible material unwindable from said at least one reel around said palletized load;

if said wrapping head is at the lower end of said palletized load, activating said folding group for said extensible material, so that said folding group engages and folds at least one peripheral portion (p) of said extensible material on itself, thereby obtaining a double layer band (F) of said extensible material;

said folding of at least one peripheral portion (p) of said extensible material being guided by guide means that curve said extensible material by means of at least one curving means, connected to said support framework at the articulation of said tiltable means, said at least one curving means being arranged along said axis (y-y);

said curving means including a rounded element at the lower part, made of any suitable anti-stick material, having a section with concavity facing towards the upper plate of the wrapping head, with radius of curvature such to allow the sliding of the extensible material exiting from the return means and, at the same time, capable of accompanying the material during the folding step thus avoiding the occurrence of unwanted sticking.

14. The method according to claim 13, comprising a step of adjusting the position of said tiltable means of said at least one folding group with respect to said support framework as a function of the width desired for said double layer.

15. The method according to claim 13, wherein said wrapping head is provided with said tiltable means and said actuator means longitudinally translatable along the axis (x-x), comprising a step of adjusting the position thereof with respect to said support framework as a function of the desired width for said double layer.

* * * * *